US008307866B2

(12) United States Patent
Leonard

(10) Patent No.: US 8,307,866 B2
(45) Date of Patent: Nov. 13, 2012

(54) WOOD CHIPPER WITH IMPROVED FEED ROLLER AND ADJUSTABLE LEGS

(76) Inventor: Mark A. Leonard, Kelso, WA (US)

( * ) Notice: Subject to any disclaimer, the term of this patent is extended or adjusted under 35 U.S.C. 154(b) by 229 days.

(21) Appl. No.: 12/324,440

(22) Filed: Nov. 26, 2008

(65) Prior Publication Data

US 2010/0126628 A1 May 27, 2010

(51) Int. Cl.
*B27C 1/00* (2006.01)

(52) U.S. Cl. ..... 144/176; 144/181; 241/280

(58) Field of Classification Search ..... 144/162.1, 144/172–176, 286.1, 181; 241/92, 280, 282
See application file for complete search history.

(56) References Cited

U.S. PATENT DOCUMENTS 3,098,512 A * 7/1963 Kendrick ..... 144/208.8
3,861,602 A * 1/1975 Smith ..... 241/92
4,160,471 A * 7/1979 Lapointe ..... 144/176
4,702,424 A * 10/1987 Widlak ..... 241/101.76
4,796,819 A * 1/1989 Waterman ..... 241/92
5,005,620 A * 4/1991 Morey ..... 144/373
5,020,579 A * 6/1991 Strong ..... 144/176
5,076,503 A * 12/1991 Cook ..... 241/73
5,088,532 A * 2/1992 Eggers et al. ..... 144/356
5,137,219 A * 8/1992 Morey ..... 241/92
5,205,496 A * 4/1993 O'Donnell et al. ..... 241/34
5,390,865 A * 2/1995 Vandermolen et al. .. 241/101.76
5,535,795 A * 7/1996 Bunn ..... 144/195.4
6,076,340 A * 6/2000 Fowler ..... 56/13.9
6,290,155 B1 * 9/2001 Thompson et al. ..... 241/92
6,357,684 B1 * 3/2002 Morey ..... 241/301
6,435,432 B1 * 8/2002 Doskocil ..... 241/92
6,641,065 B2 * 11/2003 Bardos et al. ..... 241/30
6,814,320 B1 * 11/2004 Morey et al. ..... 241/34
6,824,089 B2 * 11/2004 Gross et al. ..... 241/261.1
7,441,718 B2 * 10/2008 Seaman et al. ..... 241/34
7,481,386 B2 * 1/2009 Hartzler et al. ..... 241/34
2007/0108323 A1 * 5/2007 Chapman et al. ..... 241/30

* cited by examiner

*Primary Examiner* — David Walczak
*Assistant Examiner* — Jennifer C Chiang
(74) *Attorney, Agent, or Firm* — Merchant & Gould PC

(57) ABSTRACT

A wood chipper includes a motor, a drive shaft, a feed roller, a feed chute, a chipping device 103, a discharge chute, and at least two adjustable legs. The feed roller has a centered horizontal position which is halfway between its minimum and maximum positions. When the feed roller is at its centered horizontal position, the motor, the drive shaft, and the feed roller are all level with one another. When the feed roller is below its centered position, the drive shaft is angled down from the motor to the feed roller. When the feed roller is above its centered position, the drive shaft is angled up from the motor to the feed roller. A plurality of guides maintain the feed roller in a level position. The legs are adjustable independent of one other to different heights. The legs angle outward at their bottom portions, where they are attached to skids.

19 Claims, 10 Drawing Sheets

WOOD CHIPPER WITH IMPROVED FEED ROLLER AND ADJUSTABLE LEGS

BACKGROUND

Wood chippers are used to break up various pieces of wood, including logs, tree trunks, limbs, and branches. A common wood chipper includes a feed roller motor, a feed roller, a feed chute, a chipping device, and a discharge chute. The feed roller motor typically drives the feed roller, which feeds material into the chipping device. The chipping device breaks the material into chips, which are then discharged from the discharge chute. Some chips are collected for a variety of uses.

The feed roller of a common wood chipper is typically configured with the feed roller level with the feed roller motor and feed drive shaft of the wood chipper when the feed chute is in an empty state. Thus, the feed roller of a common wood chipper will be approximately level with the feed roller motor of the wood chipper when the feed chute is empty. As material is placed into the feed chute, the feed roller is displaced upward to make space for the material. As the feed roller is displaced upward, the feed drive shaft connecting the feed motor to the feed roller is positioned at an angle upward from the motor to the feed roller.

As more and more material is inserted into the feed chute, the angle of the feed drive shaft becomes larger until it reaches a maximum angle when the feed chute is at a maximum capacity. As the angle of the feed drive shaft becomes larger, stress increases on the feed roller motor, feed drive shaft, feed roller, and feed system connecting joints. The stress caused by the feed drive shaft angle is particularly disadvantageous when the feed chute is near or at its maximum capacity. With the feed chute at maximum capacity, the feed roller requires more torque and power to feed the larger amounts of material into the chipping device. The feed roller does not have maximum torque or power when the feed drive shaft is disposed at a large angle from the feed roller motor and feed roller.

The feed roller of a common wood chipper might also have a first end and a second end that are displaceable independent of each other. Thus, when material is inserted into the feed chute and engaged by the feed roller, the material might move to one side or the other of the feed chute, causing the first end of the feed roller to rise higher than the second end or the second end to rise higher than the first end. When one of the two ends rises higher than the other, it causes the feed roller to angle. This is disadvantageous because an angled feed roller increases stress on the feed roller motor, feed drive shaft, feed roller, and feed system connecting joints.

A common wood chipper might also include a base with a large surface area that is helpful in keeping the wood chipper from sinking into soft soil. The bases of common wood chippers are typically shorter in width and length than the components of the wood chipper positioned above them, making the wood chippers less stable. Moreover, the unitary bases common to wood chippers make moving the wood chippers difficult. It is typically necessary to hoist a common wood chipper off the ground to move it, instead of sliding it on the ground. It is necessary with some common wood chippers to hoist the wood chipper with a crane and place it onto a vehicle for transport.

SUMMARY

In general terms, this disclosure is directed to a wood chipper including a feed roller motor, having a drive shaft with a first and second end. A feed roller is connected to the drive shaft and is driven by the feed roller motor. Specifically, the first end of the drive shaft is connected to the motor and the second end of the drive shaft is connected to the feed roller.

The feed roller has a centered position where the first end of the drive shaft is approximately level with the second end of the drive shaft. The feed roller is displaceable from the centered position in a first direction by a first maximum distance and in a second direction, opposite the first direction, by a second maximum distance approximately equal to the first maximum distance. The feed roller includes a first end and a second end. The first end of the feed roller is maintained approximately level with the second end of the feed roller by a first guide connected to the first end of the feed roller and a second guide connected to the second end of the feed roller.

The wood chipper further includes a feed chute providing access to the feed roller. Material is inserted and fed into the feed chute and engaged by the feed roller. The wood chipper further includes a chipping device. The feed roller draws the material from the feed chute and into the chipping device. The chipping device receives the material from the feed roller and breaks the material into chips. The wood chipper has a discharge chute connected to the output of the chipping device. The chips are then discharged from the discharge chute.

This disclosure also relates to a wood chipper having at least a first leg on one side of the wood chipper and a second leg on the opposite side of the wood chipper. The first leg is adjustable independent of the second leg and the second leg is adjustable independent of the first leg. The first leg can be raised, lowered, and locked at a first height and the second leg can be raised, lowered, and locked at a second height different from the first height. In example embodiments, the adjustable legs are connected to skids with chain connection means for more easily moving the wood chipper. The legs are angled out at their lower portions, so as to provide the wood chipper with a wide stance, thus increasing stability.

There is no requirement that an arrangement include all of the features characterized herein to obtain some advantage according to the present disclosure.

BRIEF DESCRIPTION OF THE DRAWINGS

Referring now to the drawings, wherein like reference numerals indicate corresponding structure throughout the several views.

DETAILED DESCRIPTION

Reference to various embodiments does not limit the scope of the claims attached hereto. Additionally, any examples set forth in this specification are not intended to be limiting and merely set forth some of the many possible embodiments for the appended claims. Although some of the examples discussed herein are directed to a wood chipper, such embodiments can alternatively be used in any of various types of machinery to form yet other embodiments according to the present disclosure.

Figure 1:
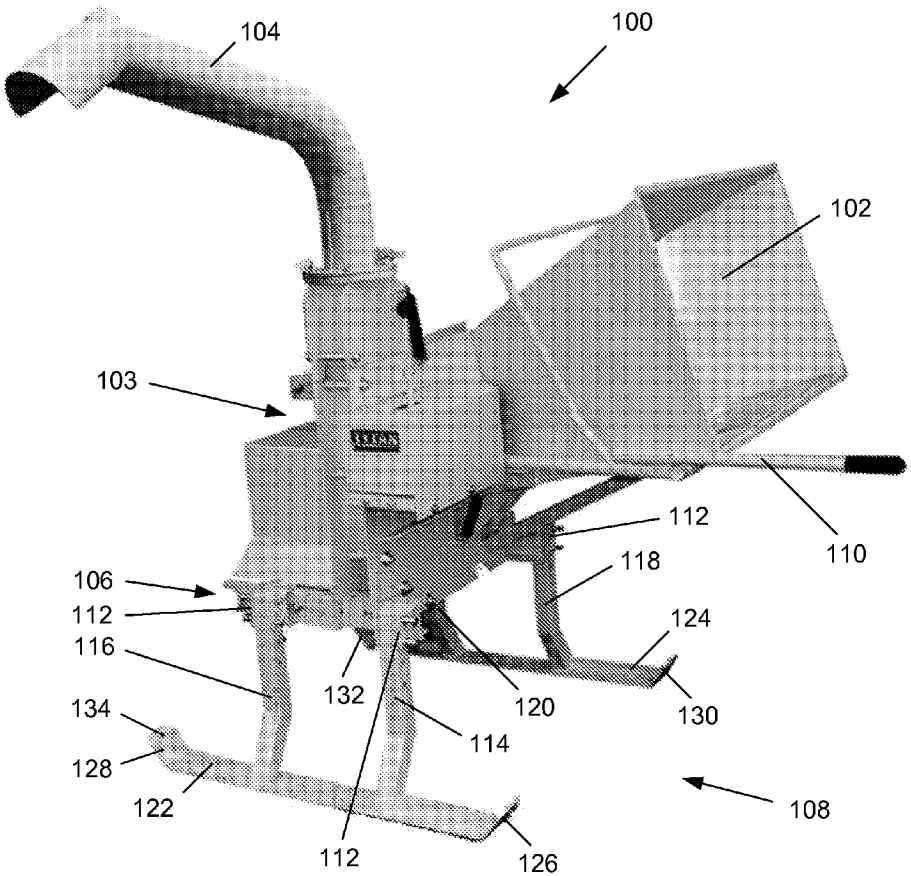
FIG. 1 is a perspective view of a wood chipper according to the present disclosure.

FIG. 1 is a perspective view of an example wood chipper 100 according to the present disclosure. Wood chipper 100 includes a hydraulic feed roller motor, a feed roller drive shaft connected to a first end of the feed roller motor, and a feed roller connected to a second end of the feed roller drive shaft. The feed roller motor, feed roller drive shaft, and feed roller are discussed in further detail below. Wood chipper 100 has a feed chute 102, a chipping device 103, a discharge chute 104, a frame 106, a plurality of adjustable legs 108, and a feed roller lift lever 110.

Figure 2:
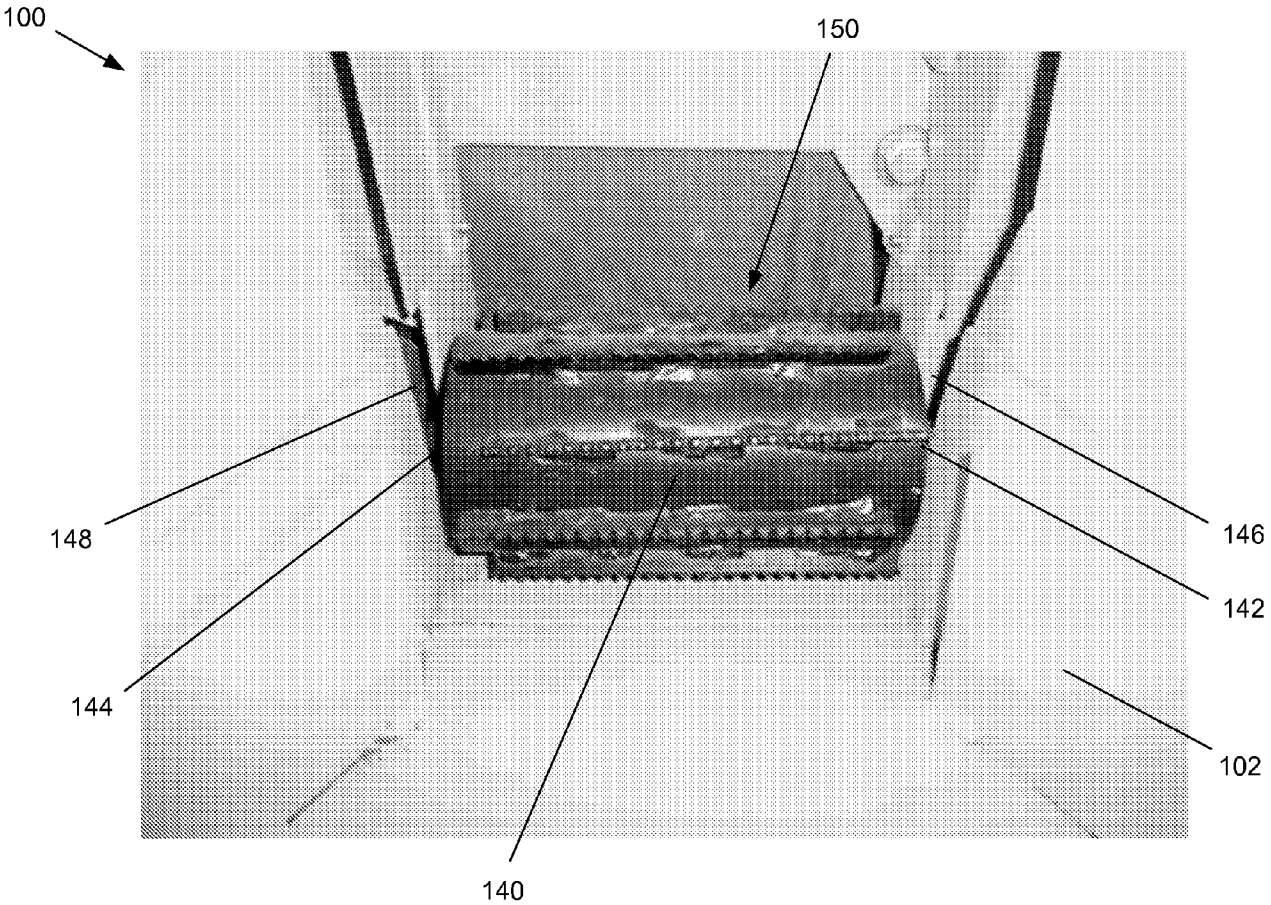
FIG. 2 is a front view of the feed roller disposed inside the feed chute of the wood chipper shown in FIG. 1 in further detail.

Referring to FIG. 2, feed chute 102 provides access to a feed roller 140. In use, material is inserted into the feed chute 102 where it is engaged by feed roller 140 and drawn into wood chipper 100. Feed roller lift lever 110 is used to lift the feed roller if necessary to aid in the insertion of material and engagement of the material by feed roller 140. Feed roller lift lever 110 is interchangeable from its position on the left side of feed chute 102 as shown in FIG. 1 to a position on the right side of feed chute 102. Changing sides of feed roller lift lever 110 is easily accomplished by the operator of wood chipper 100 on the fly. The ability to change sides of feed roller lift lever 110 provides greater flexibility and convenience for both left handed and right handed operators.

After feed roller 140 feeds the material into the chipping device 103 and the material is broken up into chips according to the description below, the chips are discharged from discharge chute 104. Feed chute 102 and discharge chute 104 are preferably made out of a strong rigid material such as steel, iron, aluminum, titanium, carbon fiber, fiberglass, plastic, or other composite material.

Frame 106 of wood chipper 100 connects feed chute 102, discharge chute 104, the chipping device 103, and other components to adjustable legs 108. In example embodiments, frame 106 of wood chipper 100 includes leg mounts 112 disposed near each of the four corners of the frame 106. In example embodiments, adjustable legs 108 include an adjustable leg 114 and an adjustable leg 116 disposed on the left side of chipper 100 and an adjustable leg 118 and an adjustable leg 120 disposed on the right side of wood chipper 100. In example embodiments, adjustable legs 114, 116, 118, and 120 are 2 inches wide and 2 inches deep.

Adjustable legs 114, 116, 118, and 120 each have an upper portion and a lower portion. The upper portions of adjustable legs 114, 116, 118, and 120 are connected to their corresponding leg mounts 112 of frame 106 of wood chipper 100. The connection of leg mounts 112 to the upper portions of adjustable legs 114, 116, 118, and 120 will be discussed in further detail below. The upper portions of adjustable legs 114, 116, 118, and 120 are approximately aligned vertically. The lower portions of adjustable legs 114, 116, 118, and 120 angle outward, away from the center of frame 106 of wood chipper 100. The lower portions of adjustable legs 114, 116, 118, and 120 angle outward to provide a wider stance for wood chipper 100. In example embodiments, the lower portions of adjustable legs 114, 116, 118, and 120 angle out at a 45 degree angle. The wider stance for wood chipper 100 increases the stability of wood chipper 100 and decreases the likelihood it will tip over during operation or transport. This wider stance will be discussed in more detail below.

The lower portions of adjustable leg 114 and adjustable leg 116 are connected to a skid 122. The lower portions of adjustable leg 118 and adjustable leg 120 are connected to a skid 124. In example embodiments, skid 122 and skid 124 are between 1 inch and 10 inches wide, between 30 inches and 60 inches long, and between one eighth of an inch and 1 inch thick. Skid 122 and skid 124 are preferably about 4 inches wide, about 45 inches long, and about one half of an inch thick. Skid 122 includes a front tip 126 at its front end and a rear tip 128 at its rear end. Skid 124 includes a front tip 130 and a rear tip 132. Front tip 126, rear tip 128, front tip 130, and rear tip 132 are curved upward to help wood chipper 100 more easily slide across the ground when pushed and pulled. The upward curves are less likely to catch on obstacles found on the ground, such as rocks, soil, plants, and other objects and materials.

Front tip 126, rear tip 128, front tip 130, and rear tip 132 also include connecting apertures 134 disposed on the upward curve for connecting ropes, chains and pulling and moving devices (only rear tip 128 has any connecting apertures 134 viewable in FIG. 1, but connecting apertures 134 are also shown on various tips in FIG. 7-10). Ropes, chains, etc. can be attached to connecting apertures 134 and used to pull and slide wood chipper 100 across the ground. Placing apertures 134 in skid 122 and skid 124 is advantageous because moving the wood chipper 100 by pulling from the skids reduces the likelihood that the wood chipper will tip over. In other embodiments, connecting apertures 134 and other connecting devices can be disposed on other parts of wood chipper 100. Frame 106, adjustable legs 114, 116, 118, and 120 and skids 122 and 124 are preferably made out of a strong rigid material such as steel, iron, aluminum, titanium, carbon fiber, fiberglass, plastic, or other composite material. In example embodiments, connecting apertures are included on other parts of wood chipper 100 to aid in hoisting. It will be appreciated that other devices can also be used to connect chains, ropes, etc., other than connecting apertures.

As shown in FIG. 2, feed roller 140 is disposed inside feed chute 102 of wood chipper 100. Feed roller 140 rotates and engages material inserted into feed chute 102. After engaging the material, feed roller 140 feeds the material into the chipping device 103 disposed on the opposite side of feed roller 140. Feed roller 140 can slide up and down inside of feed chute 102.

Feed roller 140 has a right end 142 and a left end 144. Feed chute 102 includes a right end guide 146 and a left end guide 148. Right end guide 146 is on the right side of feed chute 102 and left end guide 148 is on the left side of feed chute 102 opposite right end guide 146. Right end 142 of feed roller 140 is connected to right end guide 146 and left end 144 is connected to left end guide 148. Right end 142 of feed roller 140 is maintained approximately level with left end 144 of feed roller 140 by right end guide 146 and left end guide 148. Right end guide 146 and left end guide 148 establish boundaries to where feed roller 140 can be positioned, such that feed roller 140 can travel to a minimum position near the bottom of right end guide 146 and left end guide 148 and feed roller 140 can travel to a maximum position near the top of right end guide 146 and left end guide 148.

Feed roller 140 includes serrated teeth 150 disposed along its surface to aid the engagement of feed roller 140 with material inserted into feed chute 102. Serrated teeth 150 run lengthwise in several bands along the surface of feed roller 140 between right end 142 and left end 144. Feed roller 140 and serrated teeth 150 are preferably made out of a strong rigid material such as steel, iron, aluminum, titanium, carbon fiber, fiberglass, plastic, or other composite material.

Figure 3:
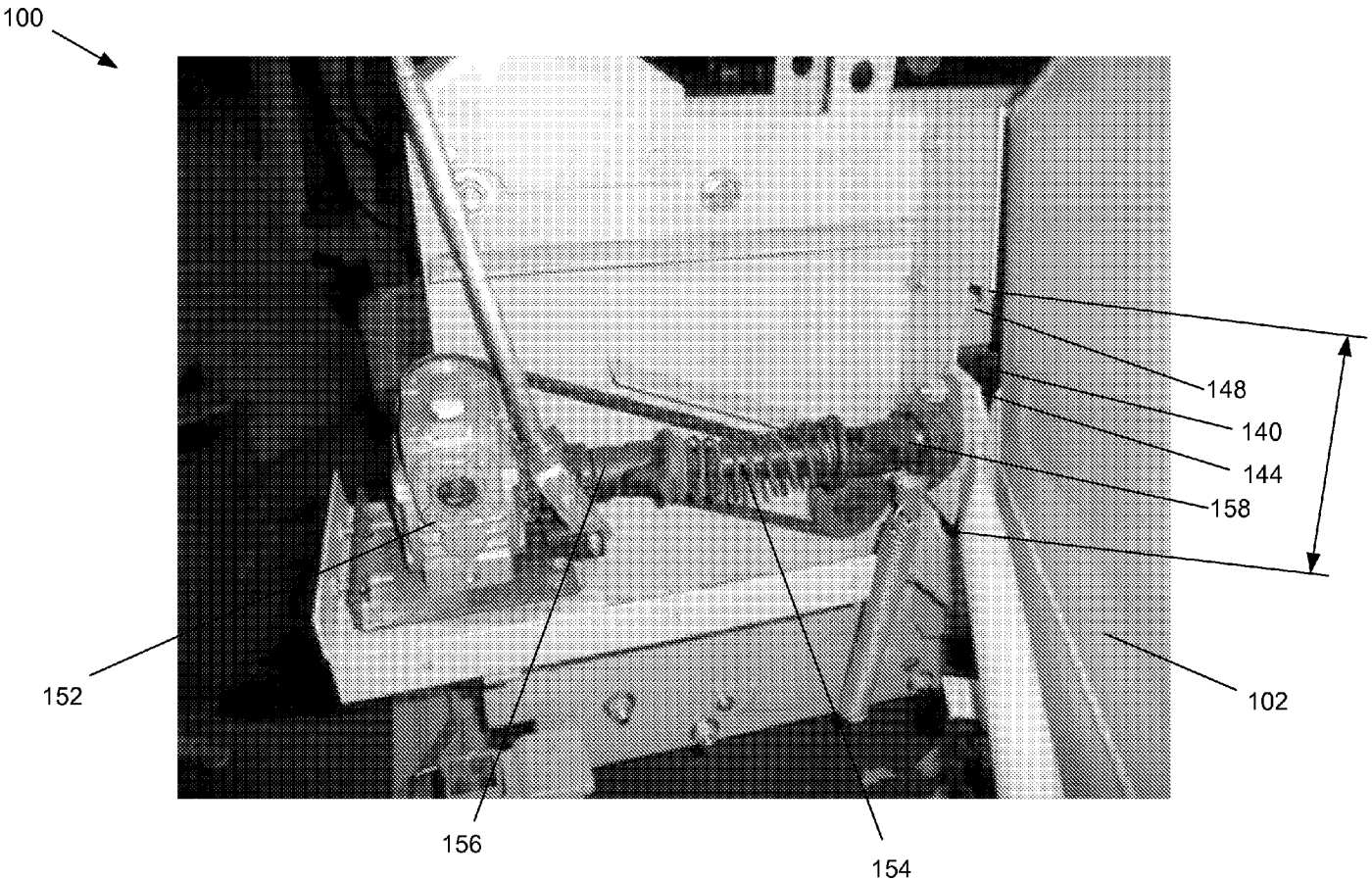
FIG. 3 is a perspective view of the motor and drive shaft of the wood chipper shown in FIG. 1 with the feed roller in a centered position.

Referring now to FIG. 3, a feed roller motor 152 is connected to a feed roller drive shaft 154 and feed roller drive shaft 154 is connected to feed roller 140. Feed roller motor 152 is a hydraulic motor with feed roller drive shaft 154 fixably connected to a left feed roller joint 156 and a right feed roller joint 158. Feed roller motor 152 is connected to feed roller drive shaft 154 at left feed roller joint 156. Right feed roller joint 158 connects feed roller drive shaft 154 with the left end 144 of feed roller 140 through left end guide 148.

Feed roller drive shaft 154 is positioned at a range of angles. Left feed roller joint 156 and right feed roller joint 158 bend as feed roller 140 raises and lowers in right end guide 146 and left end guide 148. Feed roller 140 is positioned at a centered position approximately half way between its minimum position and its maximum position. When feed roller 140 is in its centered position, feed roller motor 152, feed roller drive shaft 154, and feed roller 140 are aligned approximately linearly with one another and left feed roller joint 156 and right feed roller joint 158 are approximately unbent, minimizing binding.

Figure 4:
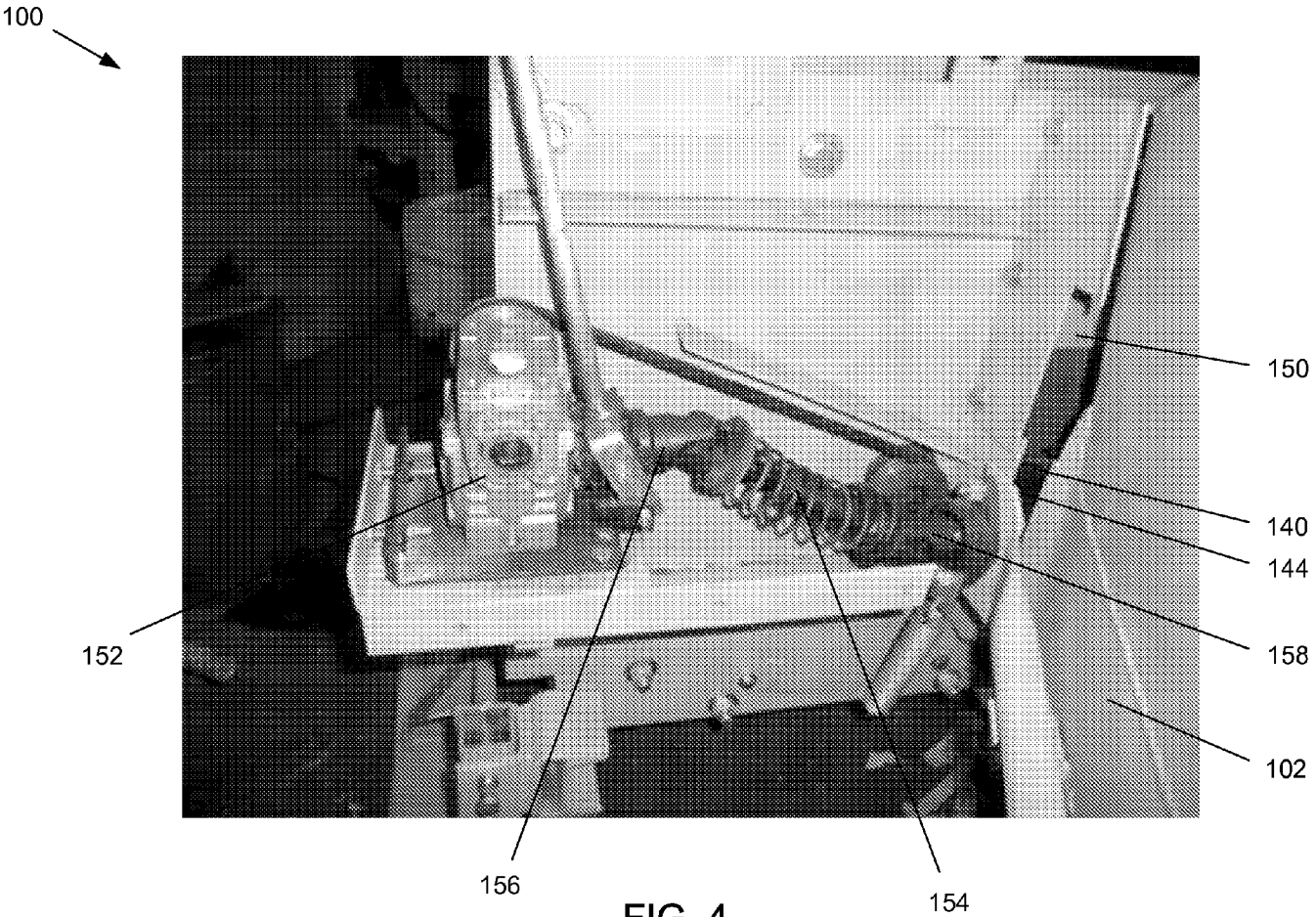
FIG. 4 is a perspective view of the motor and drive shaft shown in FIG. 3 with the feed roller in its minimum position.

As shown in FIG. 4, feed roller motor 152 is connected to a feed roller drive shaft 154 and feed roller drive shaft 154 is connected to feed roller 140. Feed roller drive shaft 154 is fixably connected to a left feed roller joint 156 and a right feed roller joint 158. Feed roller motor 152 is connected to feed roller drive shaft 154 at left feed roller joint 156. Right feed roller joint 158 connects feed roller drive shaft 154 with the left end 144 of feed roller 140 through left end guide 148.

As discussed above regarding FIG. 3, feed roller drive shaft 154 is positioned at a range of angles with help of the left feed roller joint 156 and right feed roller joint 158. When feed roller 140 is in its minimum position, feed roller drive shaft 154 angles down from a higher position at left feed roller joint 156 connected with feed roller motor 152 to a lower position at right feed roller joint 158 connected with feed roller 140. Anytime feed roller 140 is lower than its centered position, feed roller drive shaft 154 angles down from a higher position at left feed roller joint 156 connected with feed roller motor 152 to a lower position at right feed roller joint 158 connected with feed roller 140. When feed roller 140 is lower than its centered position, both left feed roller joint 156 and right feed roller joint 158 are bent.

When feed roller 140 is in its maximum position, feed roller drive shaft 154 angles up from a lower position at left feed roller joint 156 connected with feed roller motor 152 to a higher position at right feed roller joint 158 connected with feed roller 140. Anytime feed roller 140 is higher than its centered position, feed roller drive shaft 154 angles up from a lower position at a left feed roller joint 156 connected with feed roller motor 152 to a higher position at right feed roller joint 158 connected with feed roller 140. When feed roller 140 is higher than its centered position, both left feed roller joint 156 and right feed roller joint 158 are bent.

Figure 5:
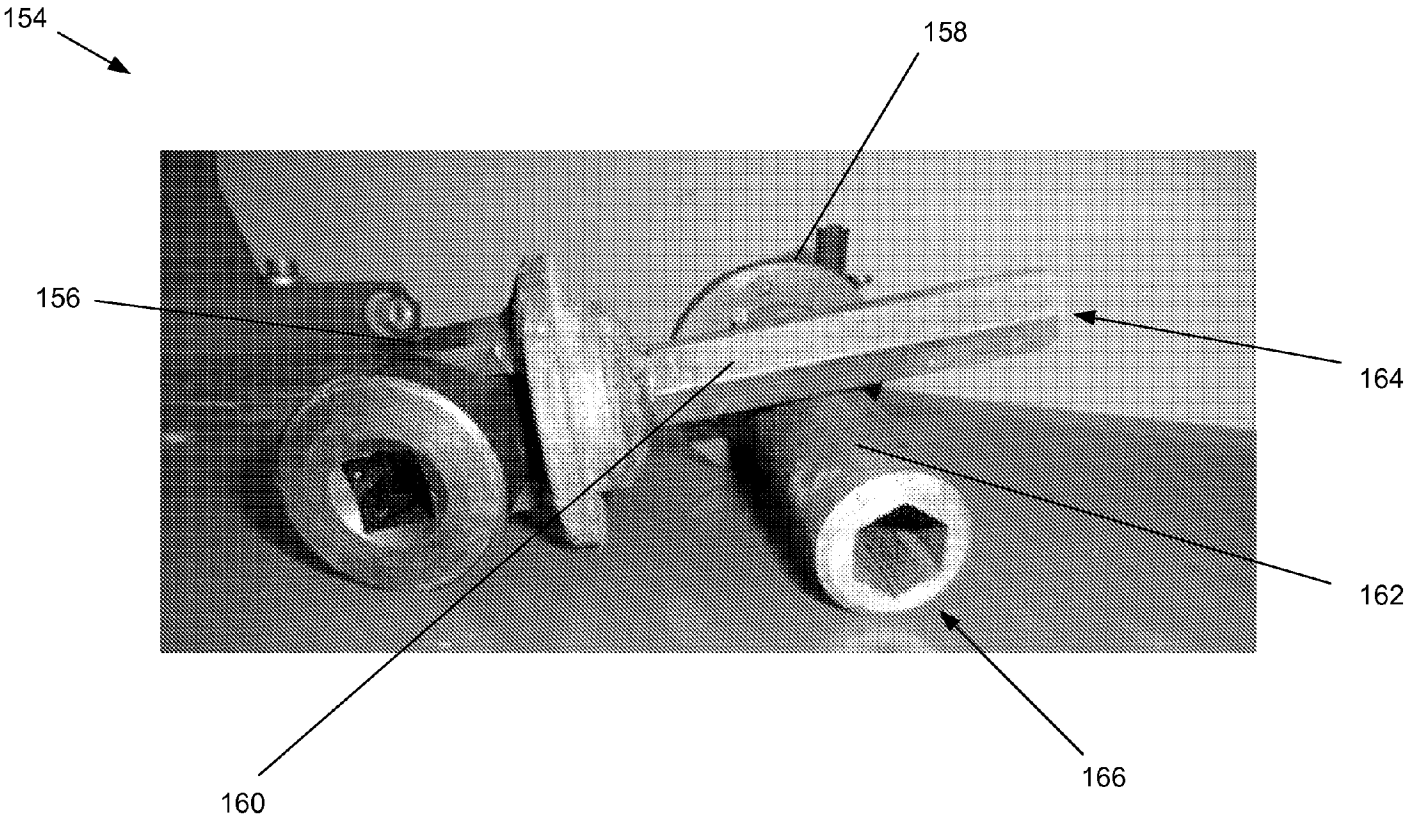
FIG. 5 is a detailed perspective view of two interconnectable pieces of the drive shaft shown in of FIG. 4 disconnected from one another.

As shown in FIG. 5, feed roller drive shaft 154 includes two shafts connected together, a male shaft 160 and a female shaft 162. Male shaft 160 and female shaft 162 are splined so that male shaft 160 is slidably connected with female shaft 162. In example embodiments, male shaft 160 has male hexagon shaped splines 164 and female shaft 162 has female hexagon shaped splines 166. Male hexagon shaped splines 164 correspond and are complementary to the female hexagon shaped splines 166, making male shaft 160 slidably connectable with female shaft 162 in a lateral direction. Male hexagon shaped splines 164 and female hexagon shaped splines 166 provide rotating power and torque from male shaft 160 to female shaft 162 and/or from female shaft 162 to male shaft 160.

Figure 6:
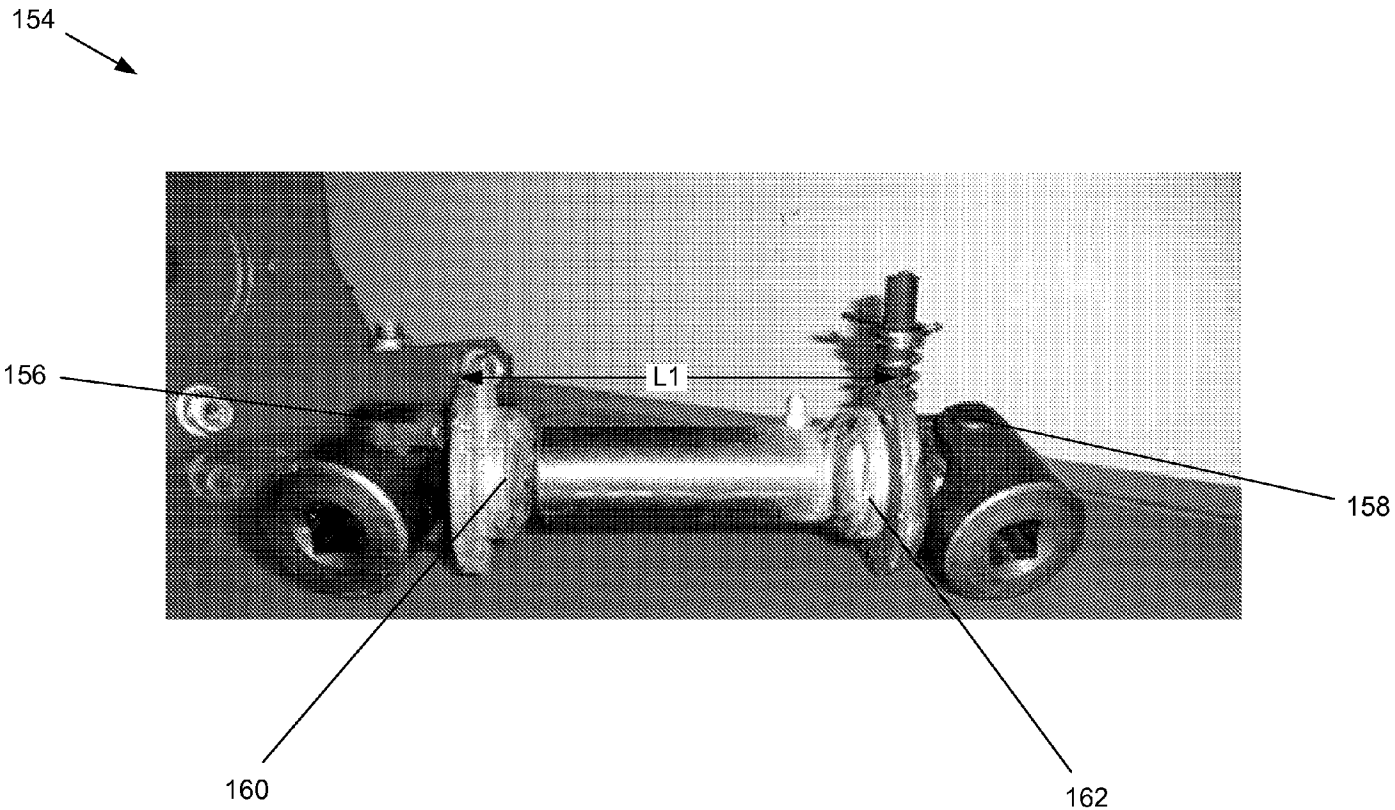
FIG. 6 is a detailed perspective view of two interconnectable pieces shown in FIG. 5 with the interconnectable pieces connected to one another.

Referring to FIG. 6, feed roller drive shaft 154 includes male shaft 160 slidably connected inside female shaft 162. The total length L1 of feed roller drive shaft 154, including splined male shaft 160 inside of splined female shaft 162, is variable. The total length L1 of feed roller drive shaft 154 has a minimum length while feed roller 140 is at its centered position and a maximum length while feed roller 140 is either at its lowest or highest position. As feed roller drive shaft 154 is angled either up or down, feed roller drive shaft 154 must be longer to reach the left end 144 of feed roller 140 through left end guide 148.

The total length L1 of feed roller drive shaft 154 lengthens as female shaft 162 slides away from male shaft 160. The splines on male shaft 160 and female shaft 162 are long enough such that female shaft 162 can slide away from male shaft 160 to extend feed roller drive shaft 154 (and L1) to its maximum length, without male shaft 160 disengaging female shaft 162 or loosing rotational power and torque. Thus, feed roller drive shaft 154 is still rotatable by feed roller motor 152 with sufficient power and torque to rotate feed roller 140 and feed material from feed chute 102 into the chipping mechanism.

Figure 7:
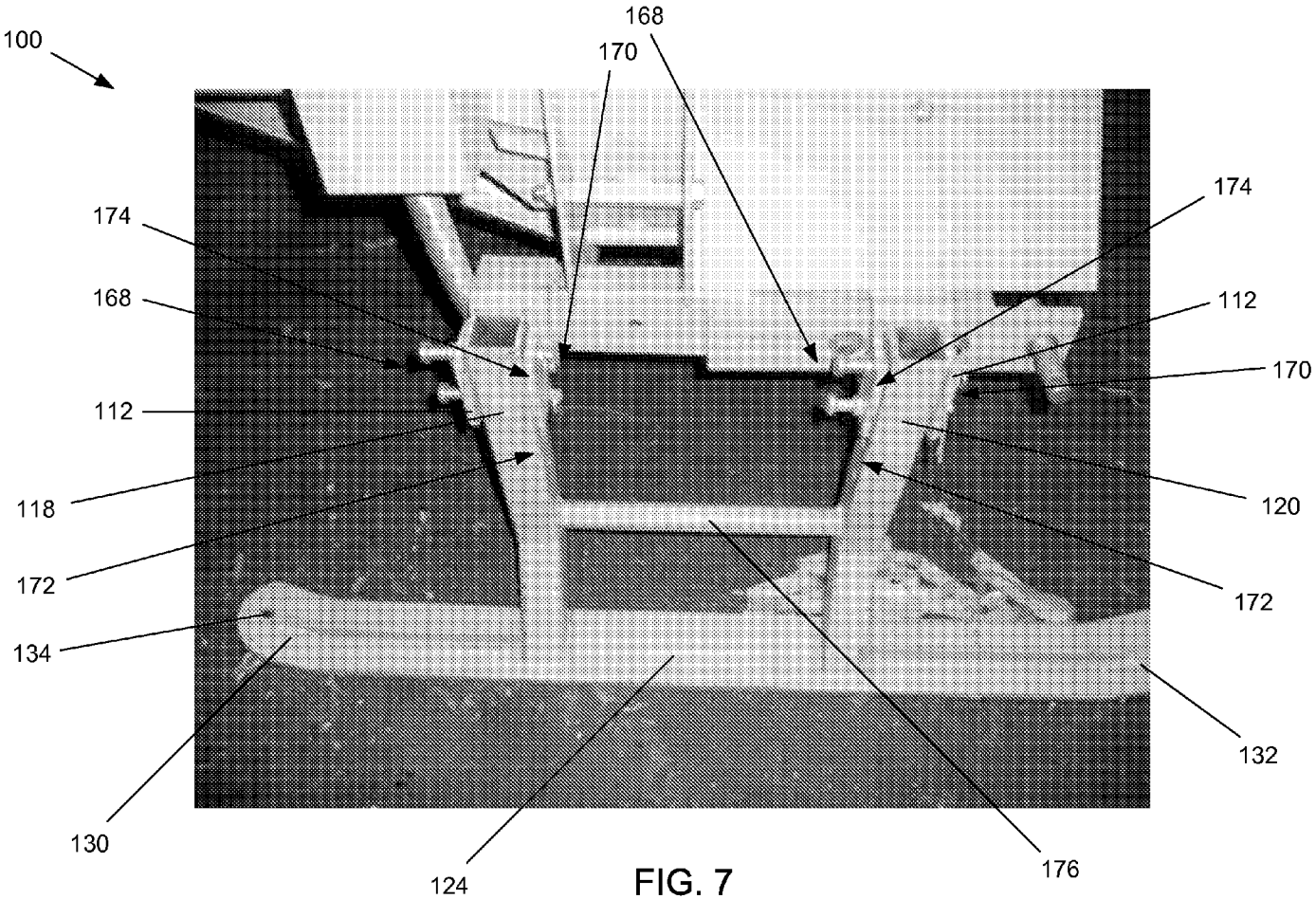
FIG. 7 is a perspective detail side view of the legs of the wood chipper shown in FIG. 1.
Figure 8:
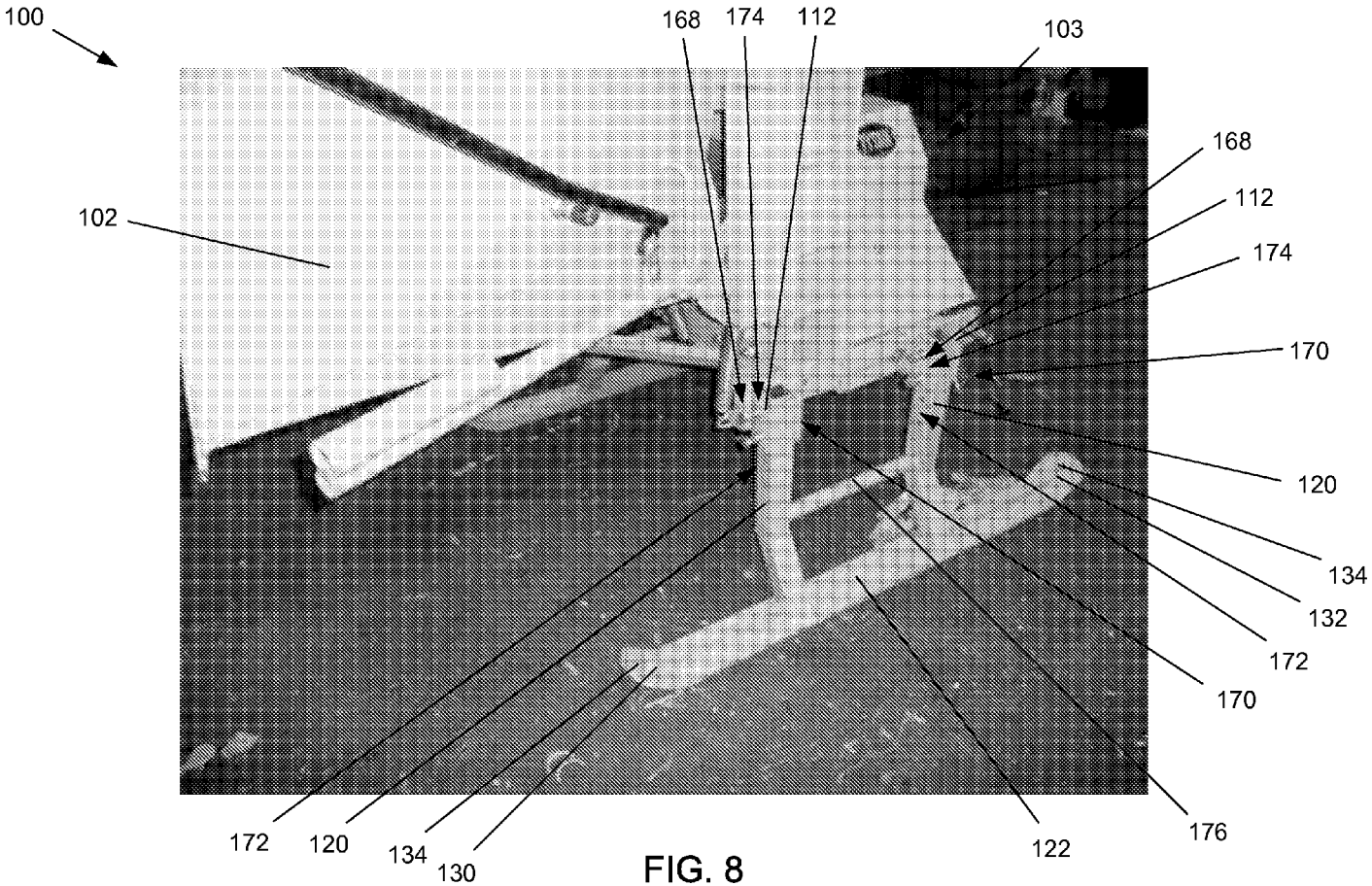
FIG. 8 is an alternate perspective view of the legs shown in FIG. 7.

As shown in FIG. 7-8, adjustable legs 108 are attached to frame 106 of wood chipper 100 at leg mounts 112. In example embodiments, plurality of adjustable legs 108 are attached to frame 106 of wood chipper 100 using a series of bolts 168 and pins 170. The upper portions of adjustable legs 114, 116, 118, and 120 include a series of leg adjustment apertures 172. In the embodiment shown, there are four leg adjustment apertures 172 on each of adjustable legs 114, 116, 118, and 120. Frame 106 of wood chipper 100 includes frame adjustment apertures 174 which correspond to leg adjustment apertures 172. In example embodiments, there are two frame adjustment apertures 174.

The upper portions of adjustable legs 114, 116, 118, and 120 are placed into corresponding leg mounts 112 so that two leg adjustment apertures 172 are lined up with the two frame adjustment apertures 174 for each of adjustable legs 114, 116, 118, and 120. Next, two bolts 168 are placed through the two leg adjustment apertures 172 and two frame adjustment apertures 174 of each of adjustable legs 114, 116, 118, and 120. Finally, pins 170 are connected to the proper end of bolts 168 to secure the legs in place. Two bolts 168 are placed through two leg adjustment apertures 172 and two frame adjustment apertures 174 to provide added security and stability.

Each of adjustable legs 114, 116, 118, and 120 has at least four leg adjustment apertures 172, allowing each leg to be adjusted to three distinct heights. In other embodiments, fewer or more leg adjustment apertures are included. In other embodiments, the legs are adjustable in other ways according to the present disclosure, such as with screws. Adjustable leg 118 is connected to adjustable leg 120 near the boundary between the upper and lower portions of adjustable leg 118 and adjustable leg 120 by at least one connecting member 176. A connecting member 176 is used in a similar manner to connect adjustable leg 114 to adjustable leg 116. At least one connecting member 176 further strengthen and stabilize wood chipper 100 on adjustable legs 114, 116, 118, and 120.

Adjustable legs 108 are adjustable individual of one another. Each of adjustable legs 114, 116, 118, and 120 can be adjusted to various heights independent of the height of the other legs. The independent adjustment of adjustable legs 114, 116, 118, and 120 is limited by the attachment of skid 122 and skid 124. In embodiments including skid 122 and skid 124, adjustable legs 114 and 116 are both adjusted to a first height, while adjustable legs 118 and 120 are both adjusted to a second height, which is different than the first height.

Figure 9:
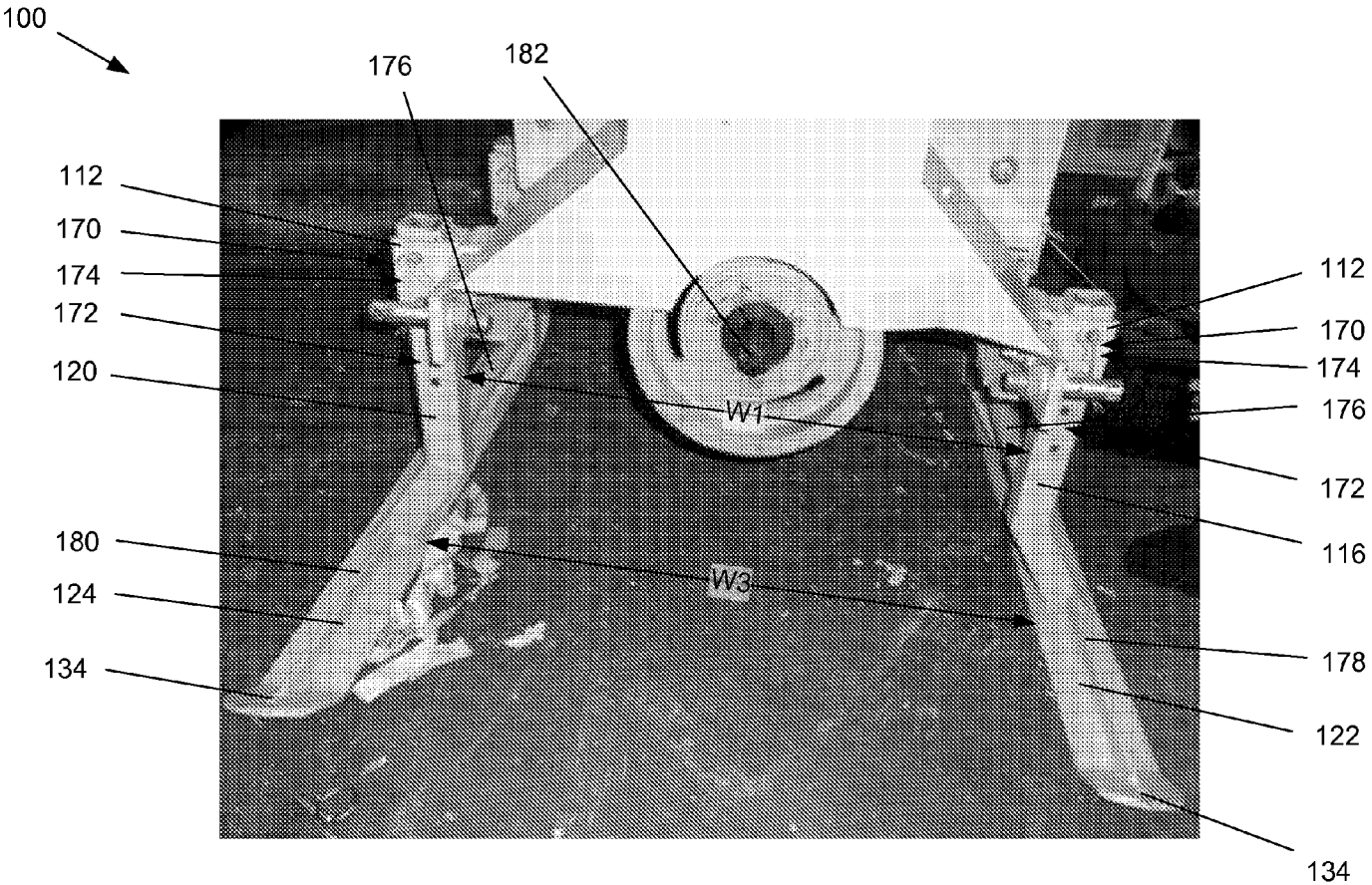
FIG. 9 is a perspective rear detail view of the legs and power take off connector of the wood chipper shown in FIG. 1.

As shown in FIG. 9, adjustable legs 114, 116, 118, and 120 each have an upper portion and a lower portion. The upper portions of adjustable legs 114, 116, 118, and 120 are connected to their corresponding leg mounts 112 of frame 106 of wood chipper 100. The connection of leg mounts 112 to the upper portions of adjustable legs 114, 116, 118, and 120 is discussed above in the description of FIG. 7-8. The upper portions of adjustable legs 114, 116, 118, and 120 are approximately aligned vertically. The lower portions of adjustable legs 114, 116, 118, and 120 angle outward, away from the center of frame 106 of wood chipper 100.

Figure 10:
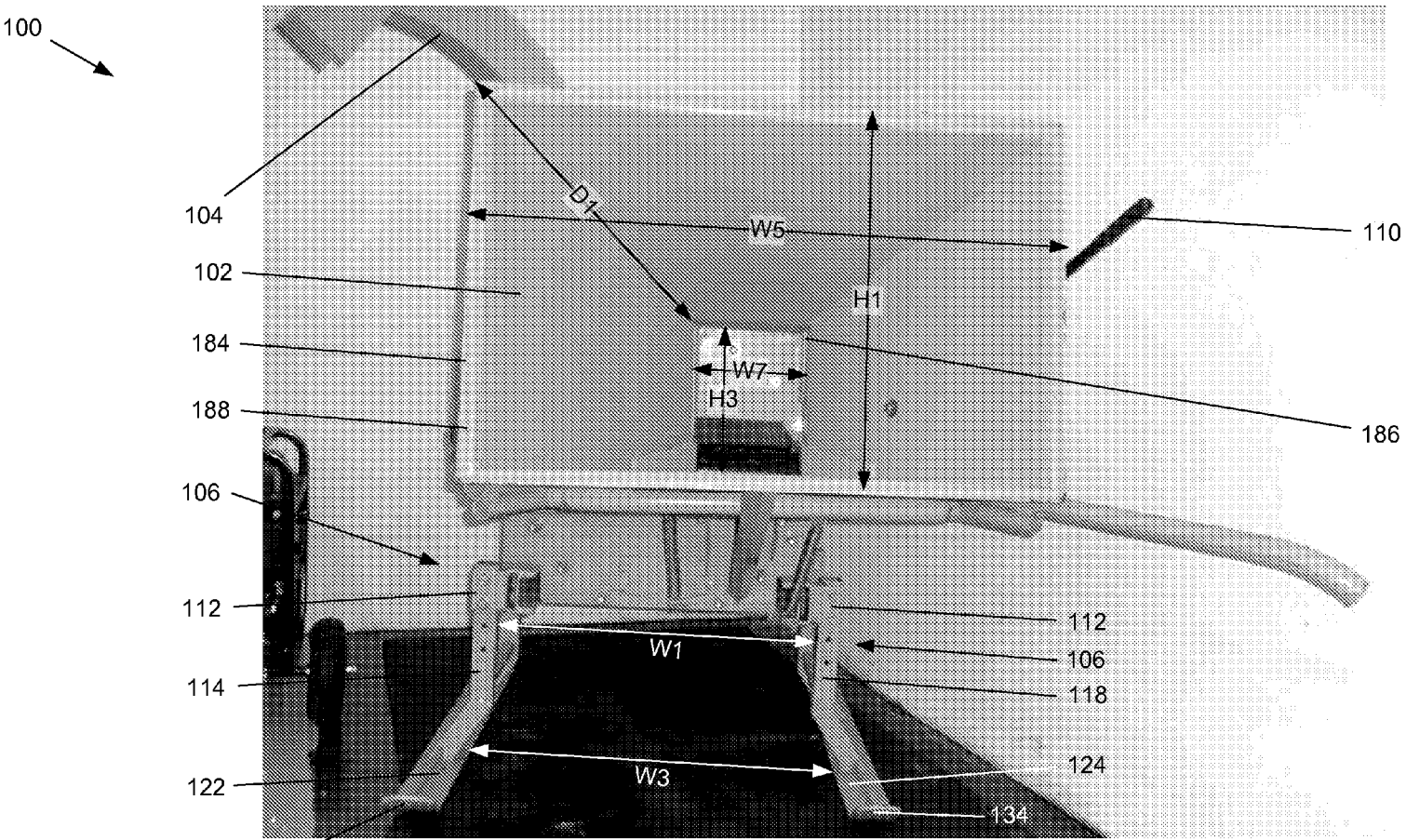
FIG. 10 is a perspective front view of details of the feed chute for the wood chipper shown in FIG. 7.

As shown in FIG. 9-10, a width W1 is measured between the inner surfaces of the upper portions of adjustable leg 116 and adjustable leg 120. A width W3 is measured between the inner surfaces of skid 122 and skid 124. W3 is greater than W1. The wider stance of wood chipper 100, based on W3 being greater than W1, helps stabilize wood chipper 100 from tipping over.

Skid 122 includes a ridge 178 that runs lengthwise along the top surface of skid 122. Skid 124 includes a ridge 180 that runs lengthwise along the top surface of skid 124. Ridge 178 and ridge 180 provided increased rigidness, strength, and support to skid 122 and skid 124, respectively.

Power take off connector 182 is positioned on the rear side of wood chipper 100. Power take off connector 182 is connected with another power take off connector from an external motor or machine, such as a tractor. The tractor powers the wood chipper according to methods known in the art. Power from the tractor is used to drive feed roller motor 152.

As described above, adjustable legs 114, 116, 118, and 120 can be positioned at different heights. Adjustable legs 114, 116, 118, and 120 can be positioned independent of one another. Adjustable legs 114, 116, 118, and 120 can all be raised or lowered to properly position power take off connector 182 at the same height as the power take off connector of the tractor so that they can easily be coupled together. Adjustable legs 114 and 116 can be set at one height and adjustable legs 118 and 120 can be set at a different height to compensate for uneven terrain, such as a hill or slope. In these embodiments, the legs can be positioned with uneven heights, such that the rest of wood chipper 100, including feed roller 140, is level.

As shown in FIG. 10, wood chipper 100 includes a feed chute 102, a discharge chute 104, a frame 106, a plurality of adjustable legs 108, and a feed roller lift lever 110. Feed chute 102 includes a first opening 180 where material is inserted into feed chute 102 and a second opening 186 where material is engaged by feed roller 140 and drawn into the chipping device 103. Feed chute 102 has a depth D1, measured from first opening 184 to second opening 186. Depth D1 ranges from between about 20 inches and about 40 inches, and is preferably between about 25 inches and 35 inches.

First opening 184 of feed chute 102 has a width W5 and a height H1. Second opening 186 of feed chute 102 has a width W7 and a height H3. Feed chute tapers from being larger at first opening 184 to being smaller at second opening 186, such that W5 is greater than W7 and H1 is greater than H3. W7 is typically between about 5% and 30% the size of W5, and is preferably between about 15% and 20% the size of W5. H3 is typically between about 20% and 60% the size of H1, and is preferably between about 35% and 45% the size of H1. The combination of the short depth D1 and the large width W7 and large height H1 allow for insertion of larger material, such as limbs with wide angles between branches.

Feed chute 102 includes a rolled edge 188 situated at first opening 184. Rolled edge 188 helps reduce material being inserted into first opening 184 of feed chute 102 from getting caught on the edge and possibly damaging wood chipper 100 or injuring the operator.

The various embodiments described above are provided by way of illustration only and should not be construed to limit the claims attached hereto. Those skilled in the art will readily recognize various modifications and changes that may be made without following the example embodiments and applications illustrated and described herein, and without departing from the intended scope of the following claims.

What is claimed is:

1. A wood chipper comprising:

a feed roller motor, having a drive shaft including a first end and a second end, wherein the first end is connected to the feed roller motor, the drive shaft being positionable at a range of angles from the first end being lower than the second end to the first end being higher than the second end;

a feed roller having a centered position, connected through a guide to the second end of the drive shaft and driven by the feed roller motor, wherein:

the first end of the drive shaft is approximately level with the second end of the drive shaft when the feed roller is in the centered position;

the feed roller is displaceable from the centered position to a position at an upper end of the guide; and the feed roller is displaceable from the centered position to a position at a lower end of the guide;

a feed chute providing access to the feed roller, wherein material is inserted and fed into the feed chute and engaged by the feed roller;

a chipping device receiving the material from the feed roller and breaking the material into chips; and a discharge chute connected to the chipping device and discharging the chips.

2. The wood chipper of claim 1, wherein:

the feed roller is displaced to the position at the upper end of the guide while the feed chute is at maximum capacity; and the feed roller is displaced to the position at the lower end of the guide while the feed chute is empty.

3. The wood chipper of claim 1, wherein:

the feed roller includes a first end and a second end;

the first end of the feed roller is maintained approximately level with the second end of the feed roller.

4. The wood chipper of claim 3, wherein the first end of the feed roller is maintained approximately level with the second end of the feed roller by a plurality of guides, wherein:

a first guide is connected to the first end of the feed roller; and a second guide is connected to the second end of the feed roller, wherein the first guide and the second guide maintain the first end of the roller approximately level with the second end of the roller.

5. The wood chipper of claim 1, further comprising:

a power take off connector driving the feed roller motor, wherein when the power take off shaft is rotated, driving the feed roller motor and turning the drive shaft and feed roller.

6. A wood chipper comprising:

a feed roller motor, having a drive shaft including a first end and a second end, wherein the first end is connected to the feed roller motor, the drive shaft being positionable at a range of angles from the first end being lower than the second end to the first end being higher than the second end;

a feed roller having a first end, a second end, and a centered position, connected to the second end of the drive shaft and driven by the feed roller motor, wherein:

the first end of the drive shaft is approximately level with the second end of the drive shaft when the feed roller is in the centered position;

the feed roller is maintained approximately level with the second end of the feed roller by a plurality of guides, wherein:

a first guide is connected to the first end of the feed roller;

a second guide is connected to the second end of the feed roller, wherein the first guide and the second guide maintain the first end of the feed roller approximately level with the second end of the feed roller;

the feed roller is displaceable from the centered position to a position at upper ends of the first and second guide; and the feed roller is displaceable from the centered position to a position at lower ends of the first and second guide a feed chute providing access to the feed roller, wherein:

material is inserted and fed into the feed chute and engaged by the feed roller;

the feed roller is displaced at the upper ends of the first and second guide while the feed chute maximum capacity; and the feed roller is displaced at the lower ends of the first and second guide while the feed chute is empty;

a chipping device receiving the material from the feed roller and breaking the material into chips; and a discharge chute connected to the chipping device and discharging the chips.

7. The wood chipper of claim 6, further comprising a displaceable lift lever connected to the feed roller, wherein the displaceable lift lever is interchangeable from the first end of the feed roller to the second end of the feed roller.

8. The wood chipper of claim 6, wherein the drive shaft is splined.

9. The wood chipper of claim 6, wherein:

a first end of the feed chute has a first opening with a first size;

a second end of the feed chute has a second opening with a second size;

the second size is between about 5% and about 60% of the first size.

10. The wood chipper of claim 6, wherein the feed chute further comprises an opening with a rolled edge disposed at the first end.

11. The wood chipper of claim 6, further comprising at least a first leg and a second leg, wherein:

the first leg is adjustable independent of the second leg; and the second leg is adjustable independent of the first leg.

12. The wood chipper of claim 11, wherein:

the first leg and the second leg can be raised, lowered, and locked at different heights.

13. The wood chipper of claim 11, wherein:

a first width is measured as a distance between an upper end of the first leg and an upper end of the second leg;

a second width is measured as a distance between a lower end of the first leg and the lower end of the second leg; and the second width is greater than the first width.

14. The wood chipper of claim 11, wherein:

the first leg comprises a first skid; and the second leg comprises a second skid.

15. A wood chipper comprising:

a feed roller motor having a drive shaft;

a feed roller connected through a guide to the drive shaft and driven by the feed roller motor;

wherein:

the feed roller has a centered position;

the drive shaft includes a first end connected to the motor and a second end connected to the feed roller, the drive shaft being positionable at a range of angles from the first end being lower than the second end to the first end being higher than the second end, wherein the first end is approximately level with the second end when the feed roller is in the centered position;

the feed roller is displaceable from the centered position to a position at an upper end of the guide; and the feed roller is displaceable from the centered position to a position at a lower end of the guide;

a feed chute providing access to the feed roller, wherein material is inserted and fed into the feed chute and engaged by the feed roller;

a chipping device receiving the material from the feed roller and breaking the material into chips;

a discharge chute connected to the chipping device and discharging the chips; and at least a first leg and a second leg, wherein:

the first leg comprises a first skid;

the first leg is adjustable independent of the second leg;

the second leg comprises a second skid;

the second leg is adjustable independent of the first leg;

a first width is measured as a distance between an upper end of the first leg and an upper end of the second leg;

a second width is measured as a distance between a lower end of the first leg and the lower end of the second leg; and the second width is greater than the first width.

16. The wood chipper of claim 15, further comprising chain mounts on the plurality of adjustable legs for moving the wood chipper.

17. The wood chipper of claim 15, wherein:

the feed roller is displaced to the position at the upper end of the guide while the feed chute is at maximum capacity; and the feed roller is displaced to the position at the lower end of the guide while the feed chute is empty.

18. The wood chipper of claim 15, wherein:

the feed roller includes a first end and a second end;

the first end of the feed roller is maintained approximately level with the second end of the feed roller.

19. The wood chipper of claim 18, wherein the first end of the feed roller is maintained approximately level with the second end of the feed roller by a plurality of guides, wherein:

a first guide is connected to the first end of the feed roller; and a second guide is connected to the second end of the feed roller, wherein the first guide and the second guide maintain the first end of the roller approximately level with the second end of the roller.

* * * * *